US009763483B2

(12) United States Patent
Waller et al.

(10) Patent No.: US 9,763,483 B2
(45) Date of Patent: Sep. 19, 2017

(54) SPORTS GARMENT

(75) Inventors: Tom Waller, Nottingham (GB); Chris Johnson, Nottingham (GB); Melanie Neal, Nottingham (GB); Joseph Santry, Nottingham (GB)

(73) Assignee: SPEEDO INTERNATIONAL LIMITED, London (GB)

( * ) Notice: Subject to any disclaimer, the term of this patent is extended or adjusted under 35 U.S.C. 154(b) by 571 days.

(21) Appl. No.: 14/123,706

(22) PCT Filed: Jun. 1, 2012

(86) PCT No.: PCT/GB2012/051243

§ 371 (c)(1),
(2), (4) Date: Dec. 3, 2013

(87) PCT Pub. No.: WO2012/164301

PCT Pub. Date: Dec. 6, 2012

(65) Prior Publication Data

US 2014/0096301 A1 Apr. 10, 2014

(30) Foreign Application Priority Data

Jun. 3, 2011 (GB) ..... 1109405.9

(51) Int. Cl.
*A41D 13/00* (2006.01)
*A41D 7/00* (2006.01)
(Continued)

(52) U.S. Cl.
CPC ..... *A41D 7/00* (2013.01); *A41D 13/0015* (2013.01); *A63B 21/0552* (2013.01);
(Continued)

(58) Field of Classification Search
CPC ..... A41D 13/00; A41D 13/0015; A41D 2300/22; A41D 2300/332; A41D 7/00; A41D 1/08; A41D 1/06; A41D 2600/10
(Continued)

(56) References Cited

U.S. PATENT DOCUMENTS 5,109,546 A * 5/1992 Dicker ..... A41O 13/0015 2/227
5,201,074 A * 4/1993 Dicker ..... A41O 13/0015 2/227
(Continued)

FOREIGN PATENT DOCUMENTS

EP 1 596 781 11/2005

OTHER PUBLICATIONS

International Search Report for PCT/GB2012/051243 dated Aug. 15, 2012.
(Continued)

*Primary Examiner* — Gloria Hale
(74) *Attorney, Agent, or Firm* — Marvin Petry; Stites & Harbison PLLC

(57) ABSTRACT

The present invention provides a garment (1) for covering a wearer's thighs. The garment comprises a pair of front resistance elements (6) each of which, in use, extends obliquely across the front of a respective one of the wearer's thighs. It also comprises a pair of rear resistance elements (10) each of which, in use, extends obliquely across the rear of a respective one of the wearer's thighs. Each of the front and rear resistance elements extends from a respective upper position (7, 11) located proximal to the midline (8) of the garment to a respective lower position (9, 12) located distal from the midline of the garment. This provides a stabilizing effect on the wearer's hip joint.

17 Claims, 6 Drawing Sheets

(51) Int. Cl.
*A63B 21/055* (2006.01)
*A63B 23/04* (2006.01)
*A41D 13/05* (2006.01)
*A63B 21/00* (2006.01)

(52) U.S. Cl.
CPC ..... *A63B 21/4009* (2015.10); *A63B 21/4025* (2015.10); *A63B 23/0482* (2013.01); *A41D 13/0506* (2013.01); *A41D 2400/38* (2013.01); *A63B 21/00181* (2013.01); *A63B 2208/03* (2013.01); *A63B 2209/00* (2013.01); *A63B 2225/60* (2013.01); *A63B 2244/20* (2013.01)

(58) Field of Classification Search
USPC ..... 2/69, 227, 228, 238, 67
See application file for complete search history.

(56) References Cited

U.S. PATENT DOCUMENTS 5,819,322 A * 10/1998 Dicker ..... A41D 13/0015 2/171.3
6,231,488 B1 * 5/2001 Dicker ..... A41D 13/0015 2/69
7,631,367 B2 * 12/2009 Caillibotte ..... A41D 13/0015 2/228
7,730,552 B2 * 6/2010 Ota ..... A41O 13/0015 2/227
8,356,363 B2 1/2013 Caillibotte et al.
8,407,814 B2 4/2013 Caillibotte et al.
8,578,514 B2 11/2013 Caillibotte et al.
2004/0107479 A1 * 6/2004 Dicker ..... A41D 13/0015 2/227
2004/0255358 A1 * 12/2004 Ota ..... A41D 13/0015 2/69
2010/0107299 A1 * 5/2010 Ota ..... A41O 13/0015 2/69
2010/0281593 A1 11/2010 Aloy Font
2011/0000005 A1 * 1/2011 Brown ..... A61F 5/0104 2/227
2014/0096301 A1 * 4/2014 Waller ..... A41D 7/00 2/67

OTHER PUBLICATIONS

Written Opinion by They International Searching Authority for PCT/GB2012/051243 dated Aug. 15, 2012.

* cited by examiner

SPORTS GARMENT

FIELD OF THE INVENTION

This invention relates to a garment, in particular a sports garment i.e. a garment for wearing during sporting activity. Particular examples are described in relation to swimsuits, which is a preferred use. However, the concepts can be applied to other sports and athletic garments including, for example, water polo and triathlon ear.

BACKGROUND

Athletes and swimmers typically wear tight fitting garments which help decrease air/water resistance which is especially important in competitive events.

During sporting activity, it is desirable to provide support to active muscles to reduce fatigue, and the compressive effect of these known tight-fitting garments provides some limited support. To provide increased support, it is known to provide elastic elements which provide support to muscles in the same manner as selectively bandaging or "taping" the muscle. It is also known to provide elasticity elements on the rear of the thigh which can be elongated (by a bending/flexing motion of the leg) to store energy which is subsequently released to assist movement of the wearer's leg back to its unflexed position.

As well as providing support and assisting the movement of muscles, it is also desirable to support the wearer's hip joint so that pivoting and rotating motions of the leg can be stabilised by keeping the leg adducted (i.e. held in towards the body.)

It is a preferred aim of the present invention to provide a garment which provides increased stability to the wearer's hip joint.

SUMMARY OF THE INVENTION

In a first aspect, the present invention provides a garment for covering a wearer's thighs wherein the garment comprises a pair of front resistance elements each of which, in use, extends obliquely across the front of a respective one of the wearer's thighs and a pair of rear resistance elements each of which, in use, extends obliquely across the rear of a respective one of the wearer's thighs, wherein each of said front and rear resistance elements extends from a respective upper position located proximal to the midline of the garment to a respective lower position located distal from the midline of the garment.

By providing a garment which has resistance elements on both the front and the rear of the garment for extending over the front and rear of the wearer's thighs, the elements angled away from the midline of the garment, a stabilising effect on the wearer's hip joint can be obtained. By extending from an upper position which is proximal to the garment midline (and, in use, proximal to the midline of the wearer's body) to a lower position which is distal from the garment midline, the resistance elements assist in keeping legs adducted i.e. held in line with the body. In some activities, e.g. swimming, this is advantageous because it assists with a linear body shape in the water which reduces drag resistance. The resistance elements help to support the wearer's leg muscles and anchor them to the core muscles in the wearer's torso which helps to improve stability of the leg at the hip joint.

Preferably, each respective upper position is substantially horizontally level with the wearer's respective greater trochanter when the garment is worn. This helps further stabilize the wearer's leg as the resistance elements act to support the hip joint.

Preferably, each respective upper position is located spaced from but proximal to the midline of the garment.

Preferably, each respective upper front position is located, in use, on the centre of the front of the wearer's respective thigh. Preferably, each respective lower front position is located, in use, on the wearer's respective outer thigh, preferably adjacent the knee. In this manner, the front resistance elements span the entire front length of the wearer's thigh muscles which maximises the support of the muscles and stability of the hip joint.

Similarly, it is preferred that each respective upper rear position is located, in use, on the centre of the rear of the wearer's respective thigh (below the gluteal crease). Preferably each respective lower rear position is located, in use on the wearer's respective outer thigh, preferably adjacent the knee. Again, this arrangement ensures that the rear resistance element spans the entire length of the wearer's thigh thus maximising muscle support and hip joint stability.

Preferably the garment comprises a lower torso-covering portion which extends above the thigh-covering portion. For example, the garment may be a swimming garment of the type known as jammers or it may be athletic shorts. The lower torso-covering portion may terminate at a waist band.

Preferably each front resistance element extends from its respective upper front position over the lower torso-covering portion either side of the garment midline, preferably up to the waist band. This helps anchor the leg muscles to the core muscles in the wearer's lower torso thus further improving hip joint stability.

Preferably, each rear resistance element extends from its respective upper rear position over said lower torso-covering portion either side of the midline of the garment such that, in use, each of the pair of the rear resistance elements extends across a respective one of the wearer's buttocks.

By extending the rear resistance elements over the rear of the lower torso-covering portion, the rear resistance bands can act as an energy store when the wearer's leg is bent in a first direction (in which the resistance band is stretched), the stored energy acting to assist in the movement of the wearer's leg in a second, opposite direction (in which the resistance band is returned to its rest state). This stored energy and movement assistance can be beneficial in improving the speed and precision of movement by providing a snap action to the movement.

Preferably, the rear resistance elements extend over the lower torso-covering portion substantially parallel to the midline of said garment. This helps to maximise the stretch of the rear resistance elements as the wearer's legs are bent thus maximising the snap action provided by the rear resistance elements to the movement in the second direction. Most preferably the length of the rear resistance elements is maximised (thus maximising the amount of energy that can be stored by the rear resistance elements) by extending the rear resistance elements over the lower torso-covering portion to the waist band.

A further advantage of the rear resistance elements extending over the wearer's buttocks is that they provide a compressive effect which compresses the wearer's buttocks thus reducing any form drag caused by the protrusion of the wearer's buttocks.

In preferred embodiments, each front resistance element abuts the corresponding rear resistance element at a position which, in use, is located on the wearer's outer thigh, preferably adjacent the knee. By abutting or joining the front and rear resistance bands, they effectively form a "cradle" which helps keep the hip joints stabilised and legs adducted i.e. supported in towards the body.

Preferably, the garment further comprises an upper torso-covering portion. For example, the garment may be a knee-skin swimsuit.

In preferred embodiments, the garment further comprises a rear midline resistance element which extends at least partly along the rear midline of the garment. In use, the rear midline resistance element extends at least partly along the wearers spine. Most preferably, the rear midline resistance element extends from a rear neckline of the garment to the crotch of the garment. This rear midline resistance element helps the wearer to maintain a good posture with a straight spine. This assists performance in various activities. For example, in swimming activities, the rear midline resistance element helps the wearer to maintain a linear position in the water which helps decrease water resistance and improves the effectiveness of swimming strokes.

Preferably, each front resistance element extends from its respective upper front position (e.g. at the front centre of the upper thigh) over the front of said upper torso-covering portion either side of and towards the midline of the garment such that, in use, each of the pair of the front resistance elements extends from the wearer's respective thigh towards the wearer's sternum. In this manner, the oblique extension of the front resistance elements over the front of the wearer's thighs is continued up over the torso towards the garment midline at roughly the same oblique angle. This helps improve the anchoring of the leg muscles to the core muscles since the resistance elements extend over the core muscles in the torso. This arrangement also helps promote connectivity and power transfer between the upper and lower body.

In preferred embodiments, each of the front resistance elements on the upper torso-covering portion extends obliquely away from the midline of the garment above a point which, in use, in positioned on the wearer's sternum. They may extend away towards and terminate at the respective armhole just below the shoulder strap.

It is preferable that the front and rear resistance elements are symmetrical about the midline of the garment with one of each pair extending either side of the midline. This ensures that a balanced support is provided leading to a balanced performance from both sides of the body.

The midline of the garment is a line which, when the garment is worn, extends vertically through the middle of the garment (typically dividing the garment into two symmetrical halves). For example, in a pair of jammers, the midline will run down the lower torso-covering portion to the centre of the crotch with the thigh-covering portions disposed either side of the midline.

Preferably, at least one of said resistance elements comprises an elastic seam. Preferably, the elastic seam comprises a seam (e.g. an ultrasonically welded seam or a stitched seam) heat bonded with an elastic (high stretch) tape backing. Preferably the backing tape is formed of a woven fabric, preferably including both inelastic threads (e.g. polyimide, polyurethane and/or polyester) and elastic threads (such as Lycra®). Preferably, the seam backing tape is bonded to seam using an elastic adhesive e.g. a temperature melt adhesive.

Preferably, at least one of said resistance elements comprises a splice of material having elastic properties. The material may be a textile material containing elastic threads (e.g. Lycra®). Preferably the splice fabric is a woven fabric including both inelastic threads (such as nylon) and elastic threads (such as Lycra®). Preferably, the percentage of elastic threads (e.g. Lycra®) is around 40 wt %.

Preferably, at least one of the resistance elements comprises a combination of at least one elastic seam and a splice of material having elastic properties, the at least one elastic seam securing the splice to the remainder of the garment. Preferably, the splice of material is secured to the remainder of the garment by a plurality (e.g. two) elastic seams.

Preferably, the splice of material is bound to edges of the garment rather than overlaying (other than in an amount sufficient to form a seam) the material of the garment.

Preferred embodiments of the present invention will now be described with reference to the accompanying figures in which:

DETAILED DESCRIPTION OF THE INVENTION

Figure 1:
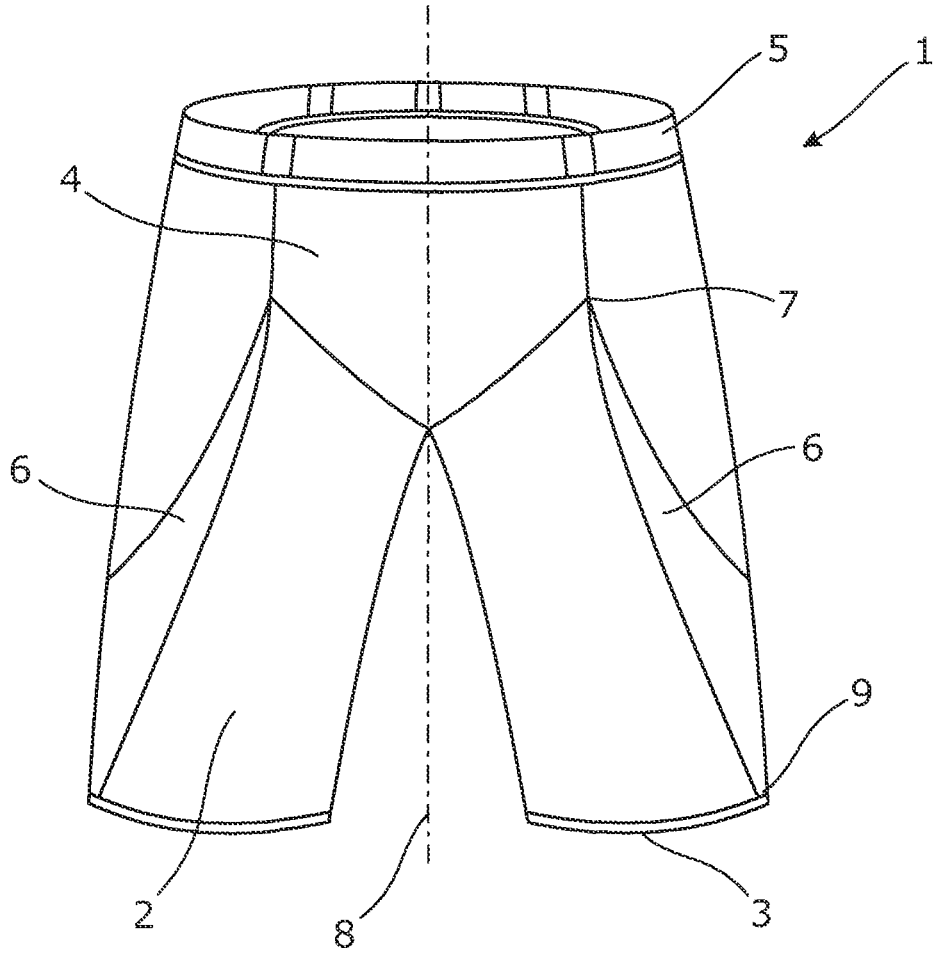
FIG. 1 is a front view of a first embodiment of the present invention.

FIG. 1 shows a front view of a pair of jammers 1 typically used by male swimmers, especially in competitive swimming.

The jammers comprise: thigh-covering portions 2 terminating at their lower ends in leg bands 3; lower torso-covering portion 4; and a waistband 5.

The jammers include a pair of front resistance elements 6, each of which is positioned so that, when the garment is being worn, they extend obliquely across the front of the respective thigh-covering portion 2.

Each front resistance element 6 extends from a respective upper front position which, when the garment is worn, is located on the centre of the front of the wearer's respective thigh (spaced from but proximal to the midline 8 of the garment) substantially horizontally level with the wearer's greater trochanter to a respective lower front position 9 on the wearer's respective outer thigh adjacent the knee (distal from the midline 8 of the garment). Thus the front resistance elements span the entire length of the front of the thigh and are angled to support the hip joint by keeping the legs adducted.

Each front resistance element 6 extends from its respective upper front position 7 over the lower torso-covering portion 4 either side of the garment midline 8 up to the waist band 5. This helps to anchor the thigh muscles to the core muscles in the wearer's lower torso thus further stabilising the muscles and hip joint.

Figure 2:
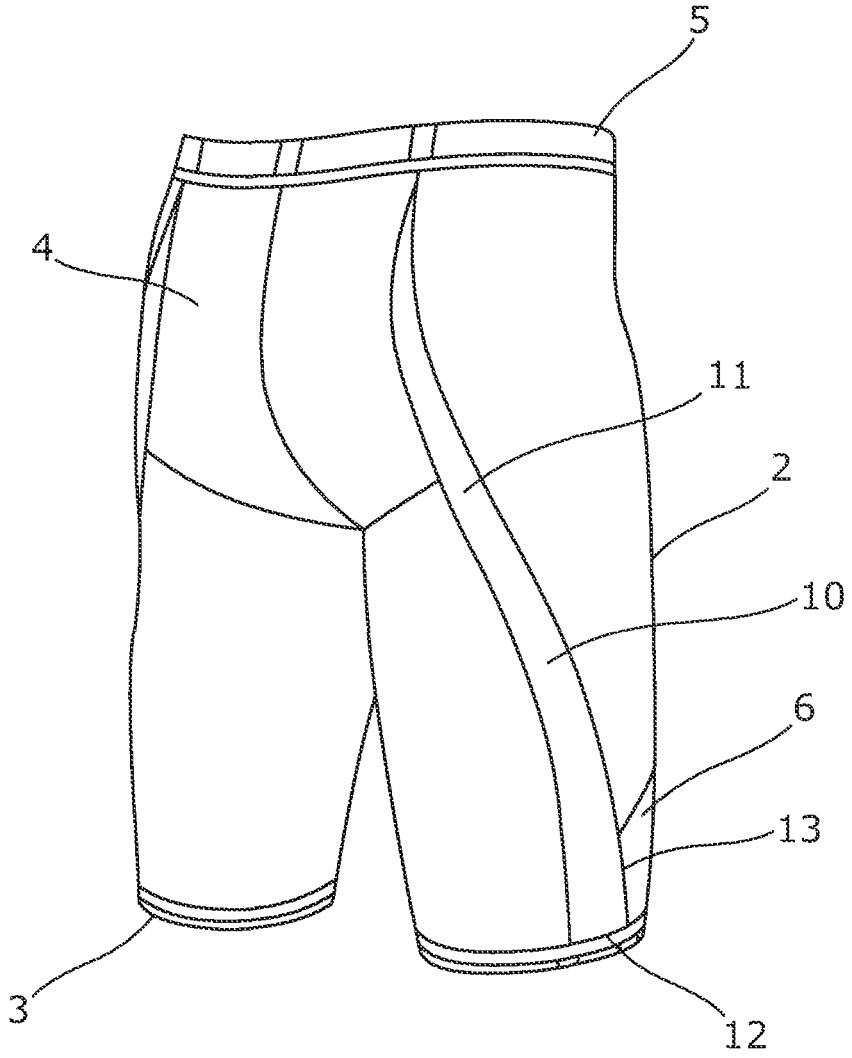
FIG. 2 is a rear side view of a first embodiment of the present invention.

FIG. 2 shows a rear side view of the jammers shown in FIG. 1.

The jammers include a pair of rear resistance elements 10 each of which is positioned so that, when the garment is being worn, they extend obliquely across the rear of the respective thigh-covering portion 2.

Each rear resistance element 10 extends from a respective upper rear position 11 which, when the garment is worn, is located on the centre of the rear of the wearer's respective thigh under the gluteal crease (proximal the midline 8 of the garment) to a respective lower front position 12 on the wearer's respective outer thigh adjacent the knee (distal from the midline 8 of the garment). Thus the rear resistance elements span the entire length of the rear of the thigh and are angled to support the hip joint by keeping the legs adducted.

Each rear resistance element 10 extends from its respective upper rear position 11 over said lower torso-covering portion 4 either side of and substantially parallel to the midline 8 of the garment so that, when the jammers 1 are worn, each of the pair of the rear resistance elements 10 extends across a respective one of the wearer's buttocks. This helps to anchor the thigh muscles to the core muscles in the wearer's lower torso thus further stabilising the muscles and hip joint. It also allows the rear resistance elements to store energy when the leg is flexed, the release of the stored energy acting to assist movement of the leg to its unflexed position.

Each front resistance element 6 abuts the corresponding rear resistance element 10 at a position 13 which is located on the wearer's outer thigh (just above the knee). This abutment creates a cradle of resistance elements which helps further support the thigh muscles and keeps the leg adducted.

Figure 3:
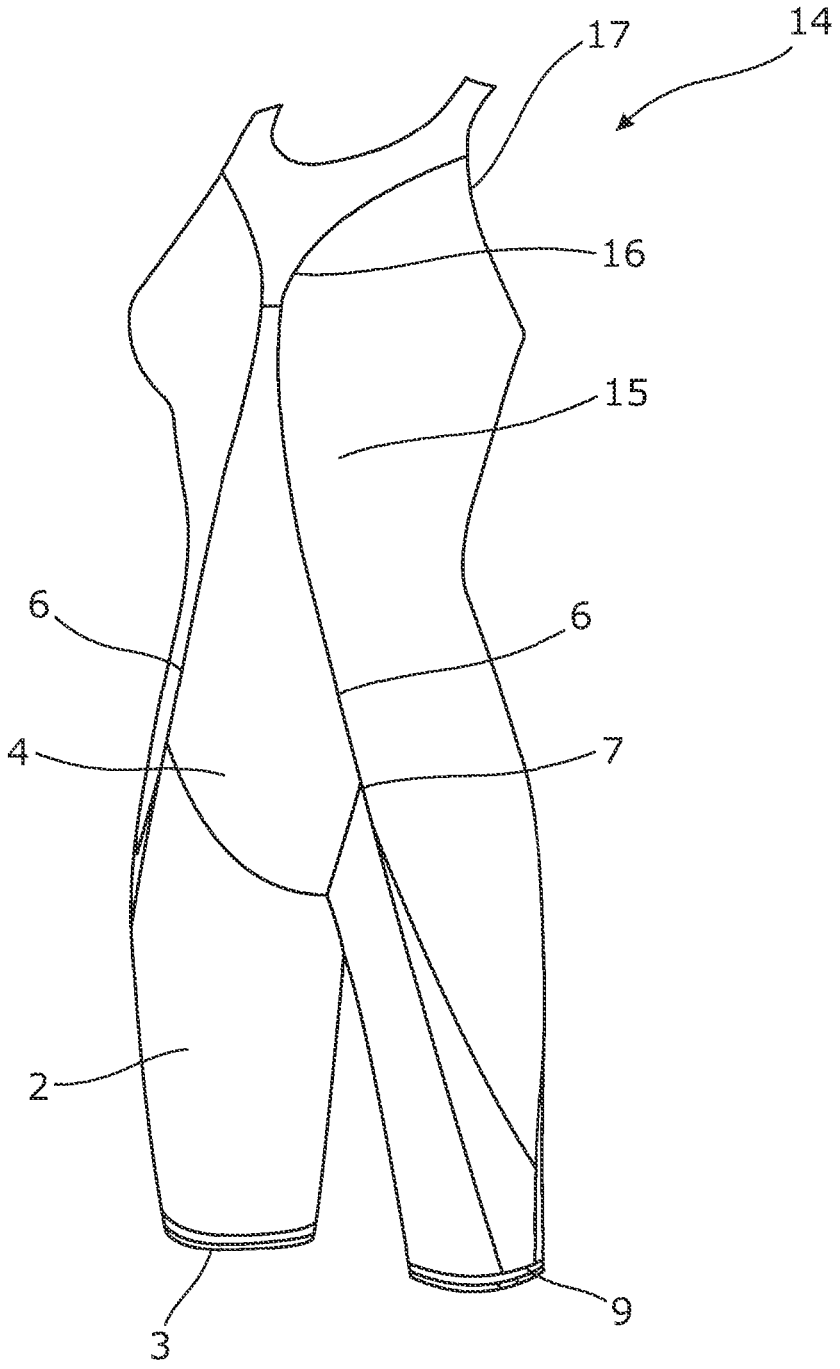
FIG. 3 is a front side view of a second embodiment of the present invention.

FIG. 3 shows a front side view of an open-backed knee skin suit 14 typically used by female swimmers, especially in competitive swimming.

The suit comprises: thigh-covering portions 2 terminating at their lower ends in leg bands 3; a lower torso-covering portion 4; and an upper torso-covering portion 15.

The suit includes a pair of front resistance elements 6, each of which is positioned so that, when the garment is being worn, they extend obliquely across the front of the respective thigh-covering portion 2.

Each front resistance element 6 extends from a respective upper front position 7 which, when the garment is worn, is located on the centre of the front of the wearer's respective thigh (spaced from but proximal to the midline 8 of the garment) substantially horizontally level with the wearer's greater trochanter to a respective lower front position 9 on the wearer's respective outer thigh adjacent the knee (distal from the midline 8 of the garment). Thus the front resistance elements span the entire length of the front of the thigh and are angled to support the hip joint by keeping the legs adducted.

Each front resistance element 6 extends from its respective upper front position 7 over the lower torso-covering portion 4 either side of the garment midline 8 up over the upper torso-covering portion 15. This helps to anchor the thigh muscles to the core muscles in the wearer's torso thus further stabilising the muscles and hip joint.

The front resistance elements 6 extend symmetrically either side of the midline 8 of the garment and the oblique angle created on the thigh-covering portion 2 is continued on the lower and upper torso-covering portions 4, 15 until the front resistance elements 6 reach a position 16 proximal the wearer's sternum when the garment is being worn. At this position 16, the front resistance elements 6 divert away from the midline 8 of the garment and extend obliquely towards the armholes 17 of the suit. By extending the front resistance elements over the upper torso, an improved connectivity and power transfer between the upper and lower body is achieved.

Figure 4:
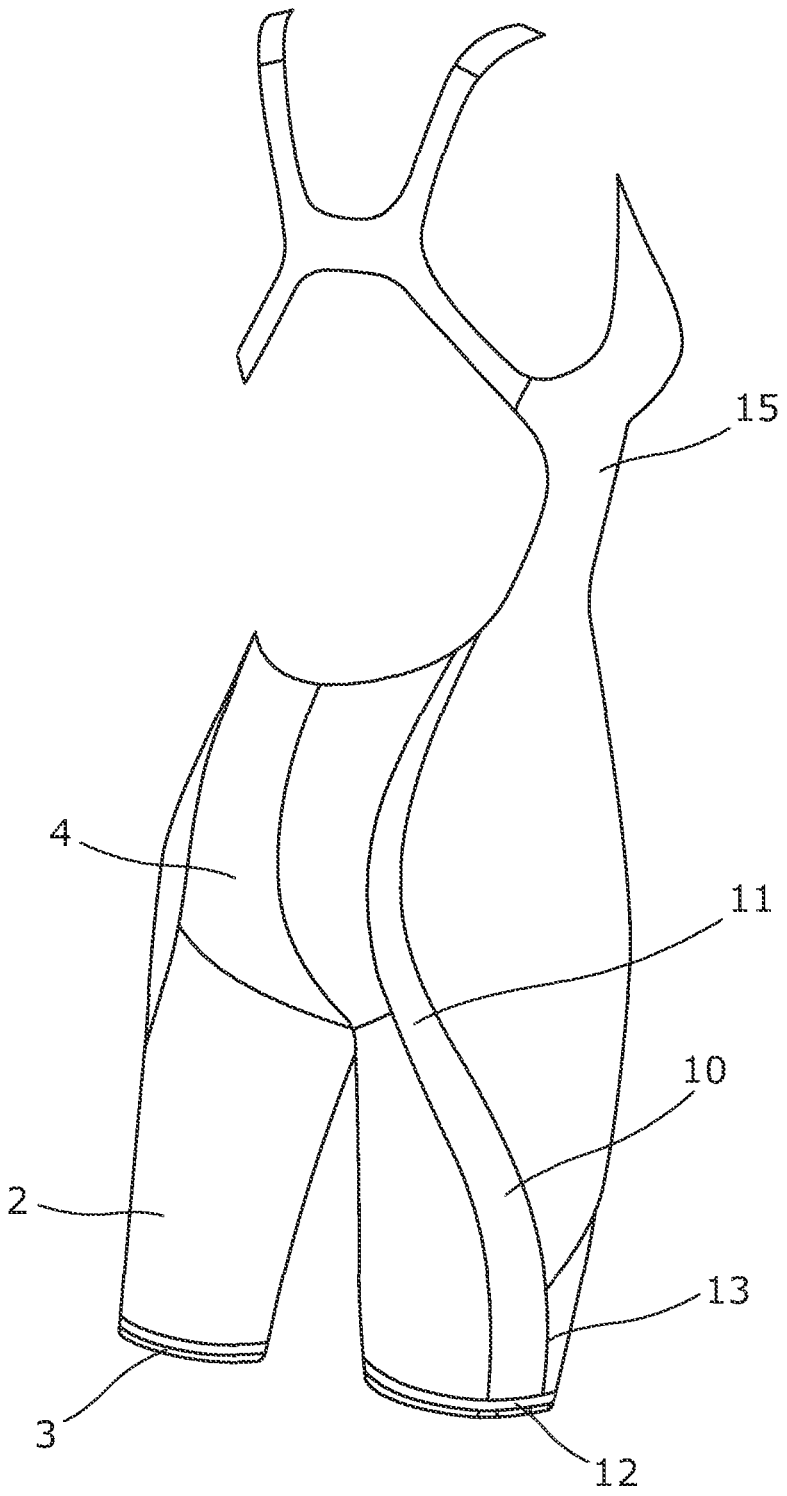
FIG. 4 is a rear side view of a second embodiment of the present invention.

FIG. 4 shows a rear side view of the suit shown in FIG. 3.

The suit includes a pair of rear resistance elements 10 each of which is positioned so that, when the garment is being worn, they extend obliquely across the rear of the respective thigh-covering portion 2.

Each rear resistance element 10 extends from a respective upper rear position 11 which, when the garment is worn, is located on the centre of the rear of the wearer's respective thigh under the gluteal crease (proximal the midline 8 of the garment) to a respective lower front position 12 on the wearer's respective outer thigh adjacent the knee (distal from the midline 8 of the garment). Thus the rear resistance elements span the entire length of the rear of the thigh and are angled to support the hip joint by keeping the legs adducted.

Each rear resistance element 10 extends from its respective upper rear position 11 over said lower torso-covering portion 4 either side of and substantially parallel to the midline 8 of the garment so that, when the suit is worn, each of the pair of the rear resistance elements 10 extends across a respective one of the wearer's buttocks. This helps to anchor the thigh muscles to the core muscles in the wearer's lower torso thus further stabilising the muscles and hip joint. It also allows the rear resistance elements 10 to store energy when the leg is flexed, the release of the stored energy acting to assist movement of the leg to its unflexed position.

Each front resistance element 6 abuts the corresponding rear resistance element 10 at a position 13 which is located on the wearers outer thigh (just above the knee). This abutment creates a cradle of resistance elements which helps further support the thigh muscles and keep the leg adducted.

Figure 5:
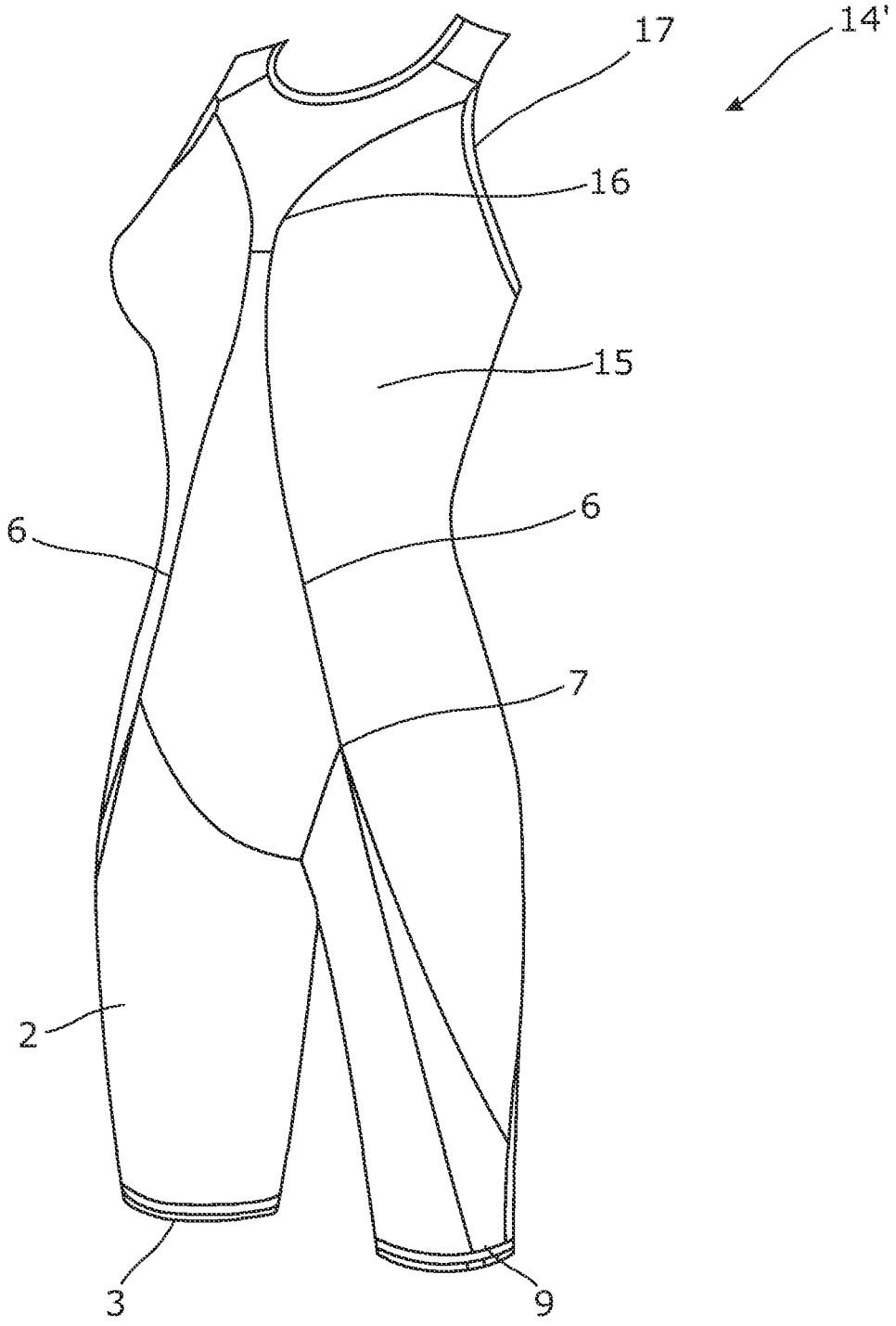
FIG. 5 is a front side view of a third embodiment of the present invention.

FIG. 5 shows a front side view of a closed-back knee skin suit 14' typically used by female swimmers, especially in competitive swimming.

The suit comprises: thigh-covering portions 2 terminating at their lower ends in leg bands 3; a lower torso-covering portion 4; and an upper for so-covering portion 15.

The suit includes a pair of front resistance elements 6, each of which is positioned so that, when the garment is being worn, they extend obliquely across the front of the respective thigh-covering portion 2.

Each front resistance element 6 extends from a respective upper front position 7 which, when the garment is worn, is located on the centre of the front of the wearer's respective thigh (spaced from but proximal to the midline 8 of the garment) substantially horizontally level with the wearer's greater trochanter to a respective lower front position 9 on the wearer's respective outer thigh adjacent the knee (distal from the midline 8 of the garment). Thus the front resistance elements span the entire length of the front of the thigh and are angled to support the hip joint by keeping the legs adducted.

Each front resistance element 6 extends from its respective upper front position 7 over the lower torso-covering portion 4 either side of the garment midline 8 up over the upper torso-covering portion 15. This helps to anchor the thigh muscles to the core muscles in the wearer's torso thus further stabilising the muscles and hip joint.

The front resistance elements 6 extend symmetrically either side of the midline 8 of the garment and the oblique angle created on the thigh-covering portion 2 is continued on the lower and upper torso-covering portions 4, 15 until the front resistance elements 6 reach a position 16 proximal the wearer's sternum when the garment is being worn. At this position 16, the front resistance elements 6 divert away from the midline 8 of the garment and extend obliquely towards the armholes 17 of the suit. By extending the front resistance elements over the upper torso, an improved connectivity and power transfer between the upper and lower body is achieved.

Figure 6:
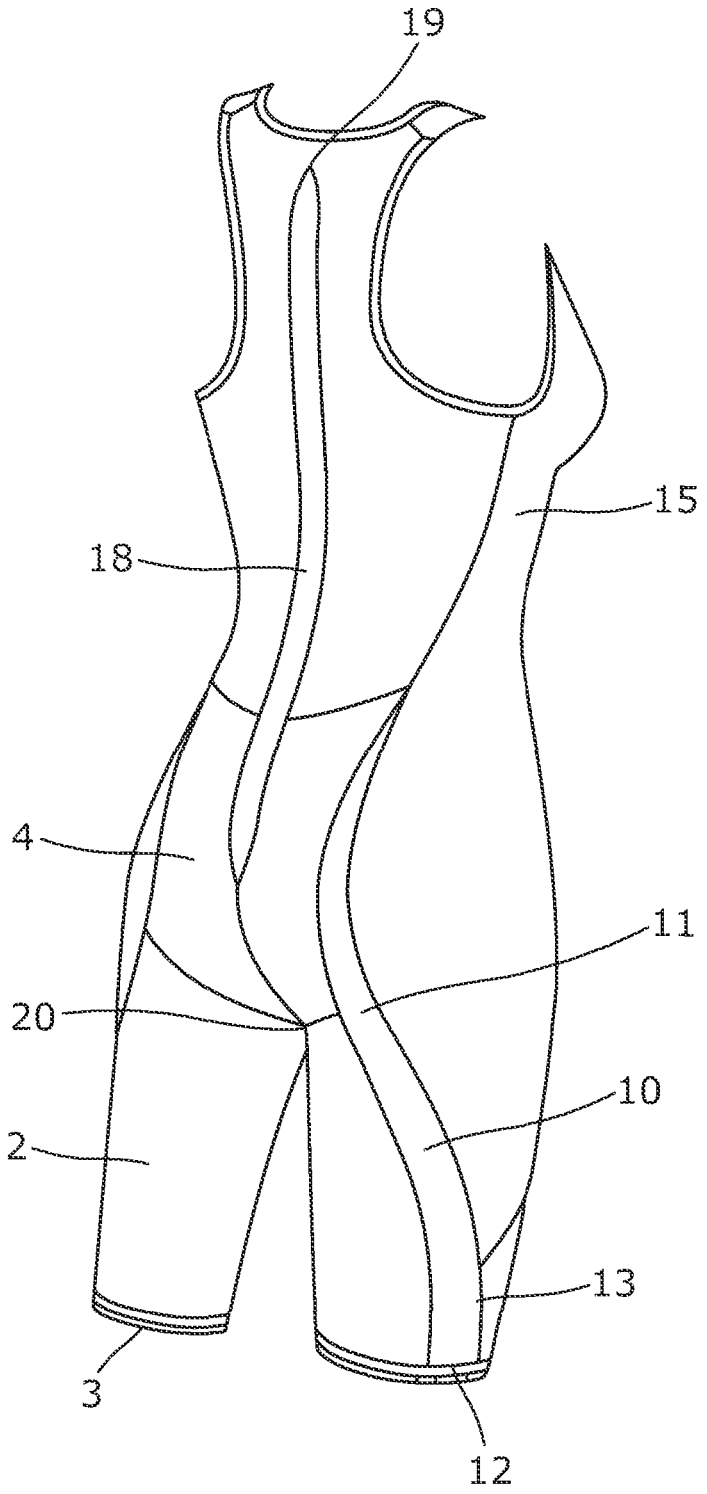
FIG. 6 is a rear side view of a third embodiment of the present invention.

FIG. 6 shows a rear side view of the suit shown in FIG. 5.

The suit includes a pair of rear resistance elements 10 each of which is positioned so that, when the garment is being worn, they extend obliquely across the rear of the respective thigh-covering portion 2.

Each rear resistance element 10 extends from a respective upper rear position 11 which, when the garment is worn, is located on the centre of the rear of the wearer's respective thigh under the gluteal crease (proximal the midline 8 of the garment) to a respective lower front position 12 on the wearer's respective outer thigh adjacent the knee (distal from the midline 8 of the garment). Thus the rear resistance elements span the entire length of the rear of the thigh and are angled to support the hip joint by keeping the legs adducted.

Each rear resistance element 10 extends from its respective upper rear position 11 over said lower torso-covering portion 4 either side of and substantially parallel to the midline 8 of the garment so that, when the suit is worn, each of the pair of the rear resistance elements 10 extends across a respective one of the wearer's buttocks. This helps to anchor the thigh muscles to the core muscles in the wearer's lower torso thus further stabilising the muscles and hip joint. It also allows the rear resistance elements 10 to store energy when the leg is flexed, the release of the stored energy acting to assist movement of the leg to its unflexed position.

Each front resistance element 6 abuts the corresponding rear resistance element 10 at a position 13 which is located on the wearer's outer thigh (just above the knee). This abutment creates a cradle of resistance elements which helps further support the thigh muscles and keep the leg adducted.

The suit further comprises a rear midline resistance element 18 which extends from the neckline 19 of the suit to the crotch 20. When worn, this resistance element follows the path of the wearer's spine and helps them maintain an advantageous posture in the water.

In all three embodiments described, the rear resistance elements 10 as they extend over thigh-covering and lower torso-covering portions comprise splices of elastic material joined to the base fabric of the suit/jammers by elastic ultrasonically welded seams, heat bonded with a high stretch tape backing. For example, the suit/jammer may be formed from a base fabric such as a warp knit fabric including both inelastic threads (such as nylon) and elastic threads (such as Lycra®). The percentage of elastic threads (e.g. Lycra®) may be around 40 wt %. The resistance elements are formed of a high stretch woven fabric including both inelastic threads (such as nylon) and elastic threads (such as Lycra®).

As the rear resistance elements extend over the upper-torso covering portion in the third embodiment, they are formed solely of the elastic ultrasonically welded seams, heat bonded with a high stretch tape backing.

Preferably the seam tape (high stretch tape backing) is a woven fabric. More preferably, it is a woven fabric tape measuring 18 mm in width including both inelastic threads (such as polyamide and polyurethane) and elastic threads (such as Lycra®). Preferably, the tape has stretch of 150%. In order for the seam tape to be bonded to create the completed seam, one side is applied with a temperature melt adhesive.

In all three embodiments described, the front resistance elements 10 as they extend over thigh-covering portions comprise splices of elastic material joined to the base fabric of the suit/jammers by elastic ultrasonically welded seams, heat bonded with a high stretch tape backing as described above in relation to the rear resistance elements.

As the front resistance elements extend over the lower and upper-torso covering portions in the second and third embodiments, they are formed solely of elastic seams as described above.

In the third embodiment, the rear midline resistance element comprises a splice of elastic material joined to the base fabric of the suit/jammers by elastic ultrasonically welded seams, heat bonded with a high stretch tape backing. This splice of material extends from just below the neckline to the middle of the lower torso-covering portion. From the neckline to the splice of material and from the splice of material to the crotch of the suit, the resistance element takes the form of an elastic seam alone.

The skilled person will appreciate that the suit/jammers illustrated in the Figures and described above are examples embodying inventive concepts described herein and that many and various modifications can be made without departing from the invention.

The invention claimed is:

1. A lower torso and leg covering garment that comprises material forming a torso covering portion and two leg portions including thigh covering portions extending therefrom configured to cover the thighs of a wearer, wherein the garment includes front resistance elements formed therein and constructed of the garment material itself, each of which, in use, extends obliquely across the thigh covering portions of the garment leg portions, and a pair of rear resistance elements, each of which, in use, extends obliquely across the rear of a respective one of the wearer's thighs, wherein each of said front and rear resistance elements extends from a respective upper position located proximal to a midline of the garment to a respective lower distal position located outwardly, farther from the midline of the garment than the proximal upper portion.

2. A garment according to claim 1 wherein, in use, each respective upper position is configured to be substantially horizontally level with the wearer's respective greater trochanter.

3. A garment according to claim 1 wherein each respective upper position is located spaced from but proximal to the midline of the garment.

4. A garment according to claim 1 wherein at least one of said resistance elements comprises an elastic seam.

5. A garment according to claim 1 wherein at least one of said resistance elements comprises a splice of elastic material.

6. A garment according to claim 1 wherein each respective resistance element upper front position is located and is configured, in use, on the center front of the wearer's respective thigh and each resistance element respective lower front position is located and is configured, in use, on the wearer's respective outer thigh.

7. A garment according to claim 1 wherein each respective resistance element upper rear position is located and is configured, in use, on the center rear of the wearer's respective thigh and each resistance element respective lower rear position is located and is configured, in use, on the wearer's respective outer thigh.

8. A garment according to claim 1 wherein the front and/or rear resistance elements extend over the lower torso covering portion to a waist band.

9. A garment according to claim 8 wherein each rear resistance element extends from its respective upper rear position over said lower torso covering portion either side of the midline of the garment and is configured such that, in use, each of the pair of the rear resistance elements extends across a respective one of the wearer's buttocks.

10. A garment according to claim 8 wherein said rear resistance elements extend over said lower torso covering portion substantially parallel to the midline of said garment.

11. A garment according to claim 1 where each front resistance element abuts the corresponding rear resistance element at a position on the garment which, in use, is configured to be located on the wearer's outer thigh.

12. A garment according to claim 1 wherein the garment further comprises an upper torso covering portion.

13. A garment according to claim 12 further comprising a rear midline resistance element which extends at least partly along the rear midline of the garment such that, in use, the rear midline resistance element is configured to extend at least partly along the wearer's spine.

14. A garment according to claim 13 wherein the rear midline resistance element extends from a rear neckline of the garment to a crotch of the garment.

15. A garment according to claim 12 wherein each front resistance element extends from its respective upper front position over the front of said upper torso covering portion either side of and towards the midline of the garment such that, in use, each of the pair of the front resistance elements are configured to extend from the wearer's respective thigh towards the wearer's sternum.

16. A garment according to claim 15 wherein each of the front resistance elements on the upper torso covering portion extends obliquely away from the midline of the garment above a point which, in use, is configured to be positioned on the wearer's sternum.

17. A garment according to claim 1 wherein the garment is a swimming garment.

* * * * *